US007865099B2

(12) United States Patent
Kobayashi et al.

(10) Patent No.: US 7,865,099 B2
(45) Date of Patent: Jan. 4, 2011

(54) IMAGE FORMING APPARATUS

(75) Inventors: Kazutoshi Kobayashi, Tokyo (JP); Yutaka Miyasaka, Tokyo (JP); Nobuyasu Tamura, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 525 days.

(21) Appl. No.: 12/015,141

(22) Filed: Jan. 16, 2008

(65) Prior Publication Data

US 2009/0016750 A1 Jan. 15, 2009

(30) Foreign Application Priority Data

Jul. 9, 2007 (JP) ..... 2007-179486

(51) Int. Cl.
*G03G 15/06* (2006.01)
*G03G 15/00* (2006.01)

(52) U.S. Cl. ..... 399/55; 399/49

(58) Field of Classification Search ..... 399/49, 399/53, 55

See application file for complete search history.

(56) References Cited

U.S. PATENT DOCUMENTS

2004/0018025 A1* 1/2004 Park et al. ..... 399/55
2004/0071477 A1* 4/2004 Do ..... 399/53

FOREIGN PATENT DOCUMENTS

JP 4-319972 A 11/1992
JP 7-175367 7/1995
JP 2001-343795 A 12/2001
JP 2006-106057 A 4/2006
JP 2006-126747 A 5/2006
JP 2007-102126 A 4/2007
JP 2007-133235 A 5/2007

OTHER PUBLICATIONS

Office Action for Japanese Patent Application No. 2007-179486 mailed Jun. 23, 2009 with English translation.
Notice of Reasons for Refusal for Japanese Patent Application No. 2007-179486 with English translation mailed Feb. 23, 2010.

* cited by examiner

*Primary Examiner*—David M Gray
*Assistant Examiner*—Joseph S Wong
(74) *Attorney, Agent, or Firm*—Cantor Colburn LLP

(57) ABSTRACT

There is described an image forming apparatus, which makes it possible to suppress quality degradation of an image on the basis of a developing electric current profile without optically detecting density of a patch image. The image forming apparatus includes: a developing current detecting sensor to detect a developing current; and a control section that conducts consecutive operations of: creating a detecting-use image pattern for detecting a developing characteristic, by aligning a plurality of image patterns, which are different from each other in density; forming a latent image of the detecting-use image pattern onto the photoreceptor element; finding a developing electric current profile, which represents a transition of the developing electric current flowing during an operation of developing the detecting-use image pattern, from an outputted signal of the developing current; and changing an image forming condition, based on the developing electric current profile found by the finding operation.

9 Claims, 12 Drawing Sheets

FIG. 8

| | COLOR TONER (Y, M, C) | BLACK TONER (K) | | |
|---|---|---|---|---|
| SWEEP SHIFTING VALUE F1 | AC FREQUENCY | AC PEAK TO PEAK | AC FREQUENCY | AC PEAK TO PEAK |
| 0 - 500 | 4.0 kHz | 1.0 kV | 5.0 kHz | 1.0 kV |
| 500 - 1500 | 4.0 kHz | 1.1 kV | 5.0 kHz | 1.1 kV |
| 1500 - 2500 | 3.5 kHz | 1.1 kV | 4.5 kHz | 1.1 kV |
| 2500 - 3500 | 3.5 kHz | 1.2 kV | 4.5 kHz | 1.2 kV |
| 3500 - 5000 | 3.0 kHz | 1.2 kV | 4.0 kHz | 1.2 kV |
| 5000- | 2.5 kHz | 1.2 kV | 3.5 kHz | 1.2 kV |

SWEEP SHIFTING DEFECT CORRECTION TABLE 400

FIG. 9

| | COLOR TONER (Y, M, C) | BLACK TONER (K) |
|---|---|---|
| LEADING PORTION WHITE DROPOUT DEFECT F2 | AC PEAK TO PEAK | AC PEAK TO PEAK |
| 0 - 700 | 1.0 kV | 1.0 kV |
| 700 - 2000 | 1.1 kV | 1.15 kV |
| 2000 - 3500 | 1.2 kV | 1.25 kV |
| 3500-5000 | 1.3 kV | 1.35 kV |
| 5000- | 1.4 kV | 1.45 kV |

LEADING PORTION WHITE DROPOUT CORRECTION TABLE 500

FIG. 10

| | COLOR TONER (Y, M, C) | BLACK TONER (K) |
|---|---|---|
| SWEEP SHIFTING VALUE F1 | TONER DENSITY | TONER DENSITY |
| 0 - 500 | 7.00 % | 7.00 % |
| 500 - 2000 | 6.70 % | 6.70 % |
| 2000 - 3500 | 6.50 % | 6.50 % |
| 3500 - 4500 | 6.20 % | 6.00 % |
| 4500 - | 6.00 % | 5.70 % |

( a ) TONER-DENSITY REFERENCE VALUE CORRECTION TABLES 600

FIG. 10

| | COLOR TONER (Y, M, C) | BLACK TONER (K) |
|---|---|---|
| LEADING PORTION WHITE DROPOUT DEFECT F2 | TONER DENSITY | TONER DENSITY |
| 0 - 800 | 7.00 % | 7.00 % |
| 800 - 2000 | 7.30 % | 7.30 % |
| 2000 - 3500 | 7.50 % | 7.50 % |
| 3500 - 5000 | 7.80 % | 7.80 % |
| 5000 - | 8.00 % | 7.80 % |

( b ) TONER-DENSITY REFERENCE VALUE CORRECTION TABLES 700

FIG. 12

| ENVIRONMENT | PRINT RATE (%) | NUMBER OF PRINTS (×1000) | SWEEP SHIFTING VALUE F1 | |
|---|---|---|---|---|
| | | | PRESENT INVENTION | HUMIDITY DETECTION |
| ORDINARY TEMPERATURE AND ORDINARY HUMIDITY | 10 | 0 | 300 | 300 |
| ORDINARY TEMPERATURE AND ORDINARY HUMIDITY | 10 | 10 | 400 | 450 |
| ORDINARY TEMPERATURE AND ORDINARY HUMIDITY | 30 | 15 | 800 | 2500 |
| ORDINARY TEMPERATURE AND ORDINARY HUMIDITY | 40 | 20 | 1200 | 4000 |
| ORDINARY TEMPERATURE AND ORDINARY HUMIDITY | 10 | 25 | 500 | 1300 |
| ORDINARY TEMPERATURE AND ORDINARY HUMIDITY | 10 | 30 | 400 | 600 |
| ORDINARY TEMPERATURE AND ORDINARY HUMIDITY | 10 | 35 | 600 | 2500 |
| ORDINARY TEMPERATURE AND ORDINARY HUMIDITY | 10 | 40 | 500 | 2000 |
| ORDINARY TEMPERATURE AND ORDINARY HUMIDITY | 30 | 45 | 1200 | 4500 |
| ORDINARY TEMPERATURE AND ORDINARY HUMIDITY | 40 | 50 | 1500 | 6000 |
| ORDINARY TEMPERATURE AND ORDINARY HUMIDITY | 10 | 55 | 600 | 2500 |
| ORDINARY TEMPERATURE AND ORDINARY HUMIDITY | 10 | 60 | 400 | 1000 |
| ORDINARY TEMPERATURE AND ORDINARY HUMIDITY | 10 | 65 | 400 | 1100 |
| ORDINARY TEMPERATURE AND ORDINARY HUMIDITY | 10 | 70 | 500 | 1150 |
| ORDINARY TEMPERATURE AND ORDINARY HUMIDITY | 30 | 75 | 1100 | 3500 |
| ORDINARY TEMPERATURE AND ORDINARY HUMIDITY | 40 | 80 | 1500 | 5500 |
| ORDINARY TEMPERATURE AND ORDINARY HUMIDITY | 10 | 85 | 700 | 2500 |
| ORDINARY TEMPERATURE AND ORDINARY HUMIDITY | 10 | 90 | 400 | 2000 |
| ORDINARY TEMPERATURE AND ORDINARY HUMIDITY | 10 | 95 | 400 | 1800 |
| ORDINARY TEMPERATURE AND ORDINARY HUMIDITY | 10 | 100 | 450 | 2200 |

PRINT RATE: 40%

ENVIRONMENTAL CONDITION: ORDINARY TEMPERATURE AND ORDINARY HUMIDITY

IMAGE FORMING APPARATUS

This application is based on Japanese Patent Application No 2007-179486 filed on Jul. 9, 2007, with Japan Patent Office, the entire content of which is hereby incorporated by reference.

BACKGROUND OF THE INVENTION

The present invention relates to an image forming apparatus, such as a copier, a facsimile, a multi-functioned apparatus having functions thereof, etc., which employs an electrophotographic method.

In the image forming apparatus employing the electrophotographic method, a toner image is acquired by developing the electrostatic latent image formed on the photoreceptor element.

When the abovementioned latent image is formed as a solid image having a predetermined density so as to output an image pattern having a uniform density all over the image concerned, it is desirable that the density of the toner image acquired by developing the latent image is constant and any density difference cannot be recognized in the reproduced image. However, in reality, the density of the toner image is fluctuated by variable factors, such as usage conditions of devices and consumable stores, environmental conditions, time variability, etc.

In order to suppress such the fluctuation, there has been widely employed in the image forming apparatus such a technology that a rectangular image pattern, which has a uniform density and is called a patch, is stored in advance, so as to change the image forming conditions based on the density of the toner image acquired by developing the latent image of the rectangular image pattern formed on the photoreceptor element.

In this connection, hereinafter, the image forming conditions mentioned in the above represents such conditions as a charging voltage, a developing bias, a toner density, etc., in regard to the toner image forming operation.

However, for instance, when a "Sweep shifting" phenomenon, in which a relatively large amount of toner are adhered onto an end edge portion of the toner image, occurs at the time of the developing operation, the density of the toner image acquired from the abovementioned patch cannot be uniform all over the toner image concerned. Accordingly, sometimes, it has become difficult to conduct an accurate density measurement.

The "sweep shifting" phenomenon, mentioned in the above, occurs remarkably in such an image forming apparatus that employs a developing bias voltage including a DC component and a AC component, which are superimposed with each other, so as to suppress the edge effect and to improve the mobility of the developing agent.

To cope with such the problem as mentioned in the above, for instance, Tokkaihei 7-175367 (Japanese Non-Examined Patent Publication) sets forth such a proposal that the toner image acquired from the patch is divided into plural areas, and the density measurement is performed for every divided area, so as to change the image forming conditions based on the detected density deviations of the toner image concerned.

With respect to a color image forming apparatus, it is necessary to accurately measure the density of the patched toner image corresponding to each of the primary colors, compared to the monochrome image forming apparatus, and sometimes, the abovementioned measurement becomes further severer.

For instance, in the color image forming apparatus employing the tandem method, the patched toner images respectively formed on the photoreceptor elements of the primary colors are sequentially transferred onto an intermediate transfer member, having a dense color, one by one.

The densities of the patched toner images aligned on the intermediate transfer member are detected at predetermined timings by a single patch sensor.

Accordingly, a wavelength sensitive range of the single patch sensor should cover such a range that is sufficient for detecting the densities of all colors represented by the patched toner images. Therefore, the S/N ratio (Signal to Noise ratio) of the detected signal acquired by the single patch sensor is liable to deteriorate, compared to that in such a case that an individual patch sensor is provided for each of the primary colors serving as the detecting objects.

Further, since colors of most of all intermediate transfer members are dense colors, for instance, a deep green color, a dense color near a black color or the like, a density difference, between density in an area to which the toner are not attached and a patch area to which the toner are attached, approaches to a smaller value. Accordingly, there has been a problem that the dynamic range for the detecting operation also becomes small.

Therefore, it is desirable that the density of the patched toner image, formed and developed on each of the photoreceptor element corresponding to each of the primary colors, is measured by the individual patch sensor before transferring it onto the intermediate transfer member, or the density of each of the patched toner images, transferred onto the intermediate transfer member, is measured by the individual patch sensor provided corresponding to each of the primary colors, so as to improve the accuracy of the measurement.

The abovementioned technology, however, would yield another problem that the cost of the apparatus increases, and/or its adjusting operation becomes complicated and cumbersome, and therefore, is not necessary employed as a good countermeasure.

SUMMARY OF THE INVENTION

To overcome the abovementioned drawbacks in conventional image forming apparatus, it is one of objects of the present invention to provide an image forming apparatus, which makes it possible to prevent the quality degradation of the image on the basis of the developing electric current profile without optically detecting the density of the patch image.

Accordingly, to overcome the cited shortcomings, at least one of the objects of the present invention can be attained by the image forming apparatus described as follows.

(1) According to an image forming apparatus reflecting an aspect of the present invention, the image forming apparatus, comprises: a photoreceptor element to form a latent image on it; a developing device to develop the latent image formed on the photoreceptor element by transferring toner residing on a developing agent bearing member onto the photoreceptor element under an alternate electric field formed in a gap between the developing agent bearing member and the photoreceptor element; a developing current detecting sensor to detect a developing current flowing through the gap between the developing agent bearing member and the photoreceptor element; and a control section that conducts consecutive operations of: creating a detecting-use image pattern for detecting a developing characteristic, by aligning a plurality of image patterns, which are different from each other in density; forming a latent image of the detecting-use image pattern onto the photoreceptor element; finding a developing electric current profile, which represents a transition of the developing electric current flowing during an operation of developing the detecting-use image pattern, from an outputted signal of the developing current detected by the developing current detecting sensor; and changing an image forming condition, based on the developing electric current profile found by the finding operation.

(2) According to another aspect of the present invention, in the image forming apparatus recited in item 1, the plurality of image patterns includes both an image pattern having a maximum density value and another image pattern having an intermediate density value.

(3) According to still another aspect of the present invention, in the image forming apparatus recited in item 1 or 2, the control section selects specific image patterns from the plurality of image patterns, and determines an aligning order or an aligning interval of the specific image patterns to create the detecting-use image pattern.

(4) According to still another aspect of the present invention, in the image forming apparatus recited in any one of items 1-3, the image forming condition to be changed by the control section is at least one of a frequency of a developing bias voltage and a Peak-to-Peak voltage of the developing bias voltage.

(5) According to still another aspect of the present invention, in the image forming apparatus recited in any one of items 1-4, the image forming condition to be changed by the control section is a density of toner to be employed by the developing device.

(6) According to still another aspect of the present invention, in the image forming apparatus recited in any one of items 1-5, the control section changes the image forming condition at such a time when a predetermined time interval has elapsed since an image forming operation of the image forming apparatus was deactivated, and the image forming operation enters into an implementable (operable) state.

(7) According to still another aspect of the present invention, in the image forming apparatus recited in any one of items 1-6, the control section changes the image forming condition at such a time when a cumulative operating time has reached to a predetermined time established in advance.

(8) According to still another aspect of the present invention, in the image forming apparatus recited in any one of items 1-7, the control section changes the image forming condition at such a time when a difference value between a print rate of an image to be currently outputted and that of another image previously outputted has reached to a predetermined value established in advance.

(9) According to yet another aspect of the present invention, in the image forming apparatus recited in any one of items 1-8, the control section changes the image forming condition at such a time when an environmental change has exceeded a predetermined range established in advance.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 8 shows an example of a sweep shifting defect correction table;

FIG. 9 shows an example of a leading portion white dropout correction table;

FIG. 10(*a*) and FIG. 10(*b*) show examples of toner-density reference value correction tables;

FIG. 12 shows a table of experimental results indicating changes of sweep shifting values.

DETAILED DESCRIPTION OF THE PREFERRED EMBODIMENT

Figure 1:
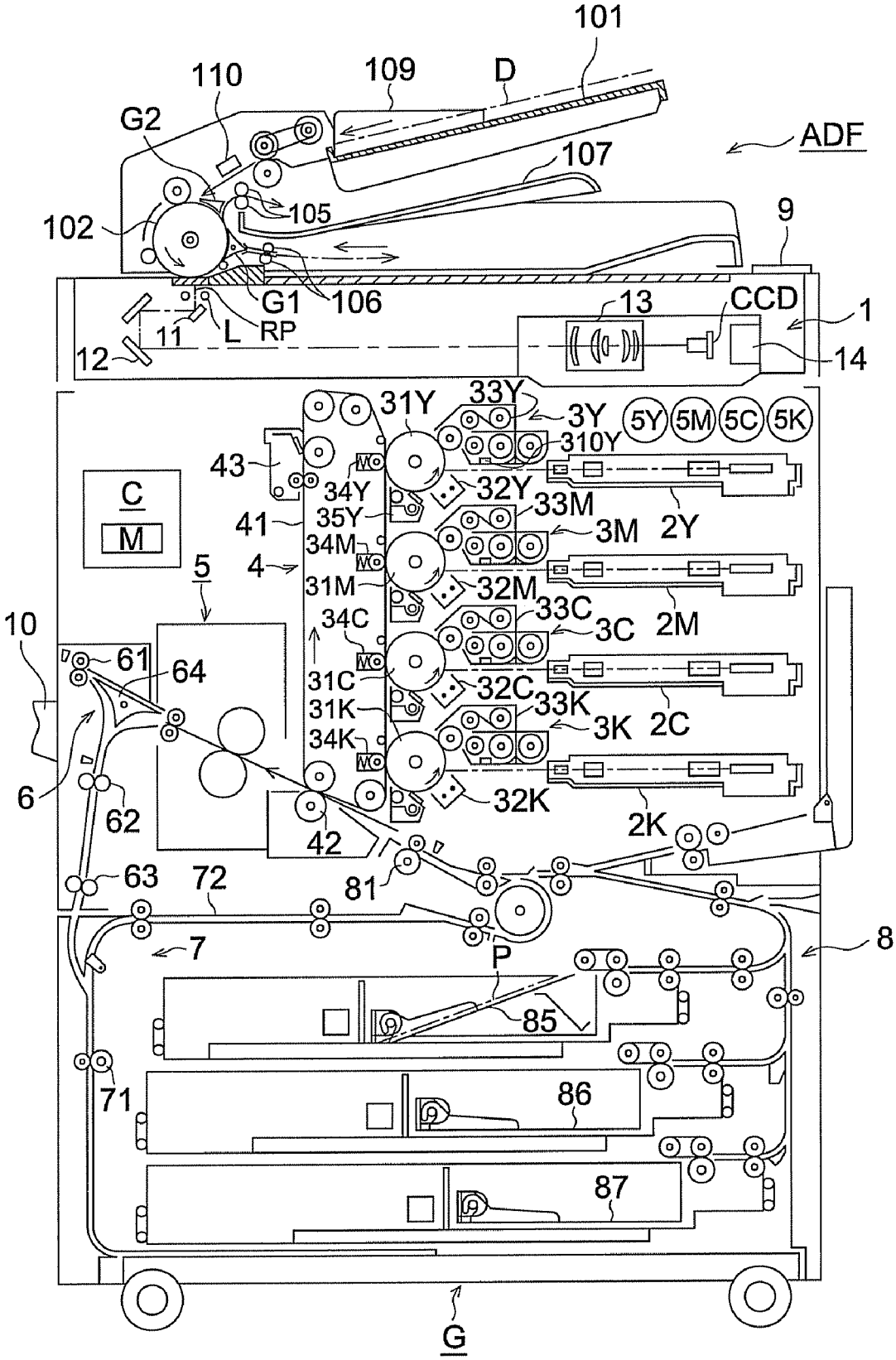
FIG. 1 shows a conceptual configuration of an image forming apparatus embodied in the present invention.

Referring to the drawings, the preferred embodiment of the present invention will be detailed in the following.

FIG. 1 shows a conceptual configuration of an image forming apparatus G embodied in the present invention.

The image forming apparatus G is a color image forming apparatus, serving as a multi-functioned apparatus, which employs a digital imaging method and has functions of a copier, a printer and a facsimile. Further, an ADF (Automatic Document Feeder) is mounted on the top portion of the image forming apparatus G.

Paper sheets, included in a document D placed on a document stacking tray 101 of an automatic document feeder ADF, are separated and conveyed one by one into a conveyance path, and further conveyed by a conveyance dram 102. An image on the document D currently conveyed is read at a reading position RP by a reading section 1, so as to achieve a reading operation. Then, the document D, for which the reading operation is completed, is further conveyed by a first conveyance guide G1 and a pair of document ejecting rollers 105 so as to eject it onto an ejecting tray 107.

When another image on a reverse side of the document D is also read, the document D, for which the reading operation of the image on the obverse side is completed, is guided to a pair of reversing rollers 106 by an action of the first conveyance guide G1, and successively, at the time when the pair of reversing rollers 106 tightly clips the trailing edge of the document D, the rotating direction of the pair of reversing rollers 106 is reversed, so as to convey the document D back to the conveyance path through the first conveyance guide G1 and a second conveyance guide G2. Successively, the other image on the reverse side (second surface) of the document D, conveyed out in a reversing mode, is also read in the same manner as reading the image on the obverse side (first surface), and then, the document D is ejected onto the ejecting tray 107.

The image forming apparatus G is constituted by the reading section 1, image writing sections 2Y, 2M, 2C, 2K, image forming sections 3Y, 3M, 3C, 3K, a transferring section 4, a fixing section 5, a reverse ejecting section 6, a paper sheet re-feeding section 7, a paper sheet feeding section stage 8, an operation display section 9, a control section C, etc.

The reading section 1 irradiates light onto the image on the document D at the reading position RP, so as to guide the reflected light to a light receiving surface of a CCD (Charge Coupled Device), serving as an image capturing element, through a first mirror unit 11, a second mirror unit 12 and a lens 13.

In an image processing section 14, various kinds of image processing, such as an analogue-to-digital conversion processing, a shading correction processing, a compression processing, etc., are applied to the image signals acquired through the photoelectronic converting actions performed in the CCD, serving as the image capturing element. The processed image data, generated in the above, are stored into a storage M.

According to the conditions designated by the user or established in advance, appropriate image processing are applied to the image data stored in the storage M as needed, in order to create output image data.

Each of the image writing sections 2Y, 2M, 2C, 2K is constituted by a laser light source, a polygon mirror, a plurality of lenses, etc.

Each of the image writing sections 2Y, 2M, 2C, 2K forms a latent image on a surface of the corresponding one of photoreceptor drums 31Y, 31M, 31C, 31K respectively equipped in the image forming sections 3Y, 3M, 3C, 3K, by conducting an exposure scanning operation, namely, by scanning a laser beam, modulated corresponding to the output image data, onto the surface of the photoreceptor drum concerned.

The image forming section 3Y is constituted by the photoreceptor drum 31Y and a charging section 32Y, a developing section 33Y, a primary transfer roller 34Y, a cleaning section 35Y, etc., which are disposed around a peripheral space of the photoreceptor drum 31Y.

The configuration of each of the image forming sections 3M, 3C, 3K is the same as that of the image forming section 3Y described in the above. Incidentally, the above-mentioned configuration of the image forming apparatus is the well-known technology widely employed for most of the color image forming apparatuses employing the electro-photographic method and currently proliferating in the market.

The latent image, formed on each of the photoreceptor drums 31Y, 31M, 31C, 31K, is developed with toner by the corresponding one of the developing sections 33Y, 33M, 33C, 33K, so as to form a toner image on each of the photoreceptor drums 31Y, 31M, 31C, 31K.

A toner density detecting sensor 310Y to detect a magnetic permeability change of the developing agent is disposed inside the developing section 33Y.

In order to control the density of toner accommodated in the developing section 33Y, a toner amount to be fed from a toner storage device 5Y is controlled on the basis of the detected signal, detected by the toner density detecting sensor 310Y, by executing a toner density controlling program 800, so as to maintain a toner density reference value determined in advance.

Concretely speaking, by executing the toner controlling program 800, the toner amount to be fed from the toner storage device 5Y is controlled so as to maintain a toner density value designated from a toner-density reference value correction tables 600, 700 in each of which various toner density values in the developing section 33Y are stored in advance in the format of table.

The unicolor toner images respectively formed on the photoreceptor drums 31Y, 31M, 31C, 31K are sequentially transferred one by one onto a predetermined position of an intermediate transfer belt 41 by primary transfer rollers 34Y, 34M, 34C, 34K provided in the transferring section 4.

The full color toner image formed on the intermediate transfer belt 41 of the transferring section 4 is further transferred onto a paper sheet P, which is fed from the paper sheet feeding section stage 8 and conveyed with an adjusted timing by a pair of paper sheet feeding rollers 81, by a secondary transfer roller 42, as the secondary transferring operation.

Successively, residual toner remaining on the surface of the intermediate transfer belt 41 after transferring the full color toner image onto the paper sheet P, are cleaned by a cleaning section 43, so as to prepare for the next image transferring operation.

On the other hand, the paper sheet P bearing the full color toner image is further conveyed into the fixing section 5, in which heat and pressure are applied to the paper sheet P by a pair of a pressure roller and a heating roller opposing to each other, so as to fix the full color toner image onto the paper sheet P.

Successively, the paper sheet P, for which the fixing processing conducted by the fixing section 5 is completed, is further conveyed by the reverse ejecting section 6, to eject it onto an ejecting tray 10.

When ejecting the paper sheet P in a surface reversing mode, the paper sheet P is once guided into the lower extended path by a changeover guide member 64, and, when the trailing edge portion of the paper sheet P is tightly clipped by a pair of reverse rollers 62, the rotating direction of the pair of reverse rollers 62 is reversed, so that the paper sheet P is guided to a pair of ejecting rollers 61 by the changeover guide member 64, and then, ejected onto the ejecting tray 10 by the pair of ejecting rollers 61.

In this connection, when further forming another image on the reverse surface of the paper sheet P, the paper sheet P, on the obverse surface of which the toner image is already fixed, is guided into the paper sheet re-feeding section 7 through the lower extended path by the changeover guide member 64, and, when the trailing edge portion of the paper sheet P is tightly clipped by a pair of reverse rollers 71, the rotating direction of the pair of reverse rollers 71 is reversed, so that the surface of the paper sheet P is reversed by conveying it in the reverse direction, and the paper sheet P is conveyed into a re-conveying path 72, so as to provide it for the image forming operation on the reverse surface.

Although the paper sheet P to be employed for the above-mentioned image-forming operation is fed from any one of paper sheet stacking trays 85, 86, 87 in the paper sheet feeding section stage 8 one by one, a paper sheet stacking tray in which paper sheets P having a size corresponding to the job set from the operation display section 9 is selected as the one actually employed for the paper sheet feeding operation from the paper sheet stacking trays 85, 86, 87.

Figure 2:
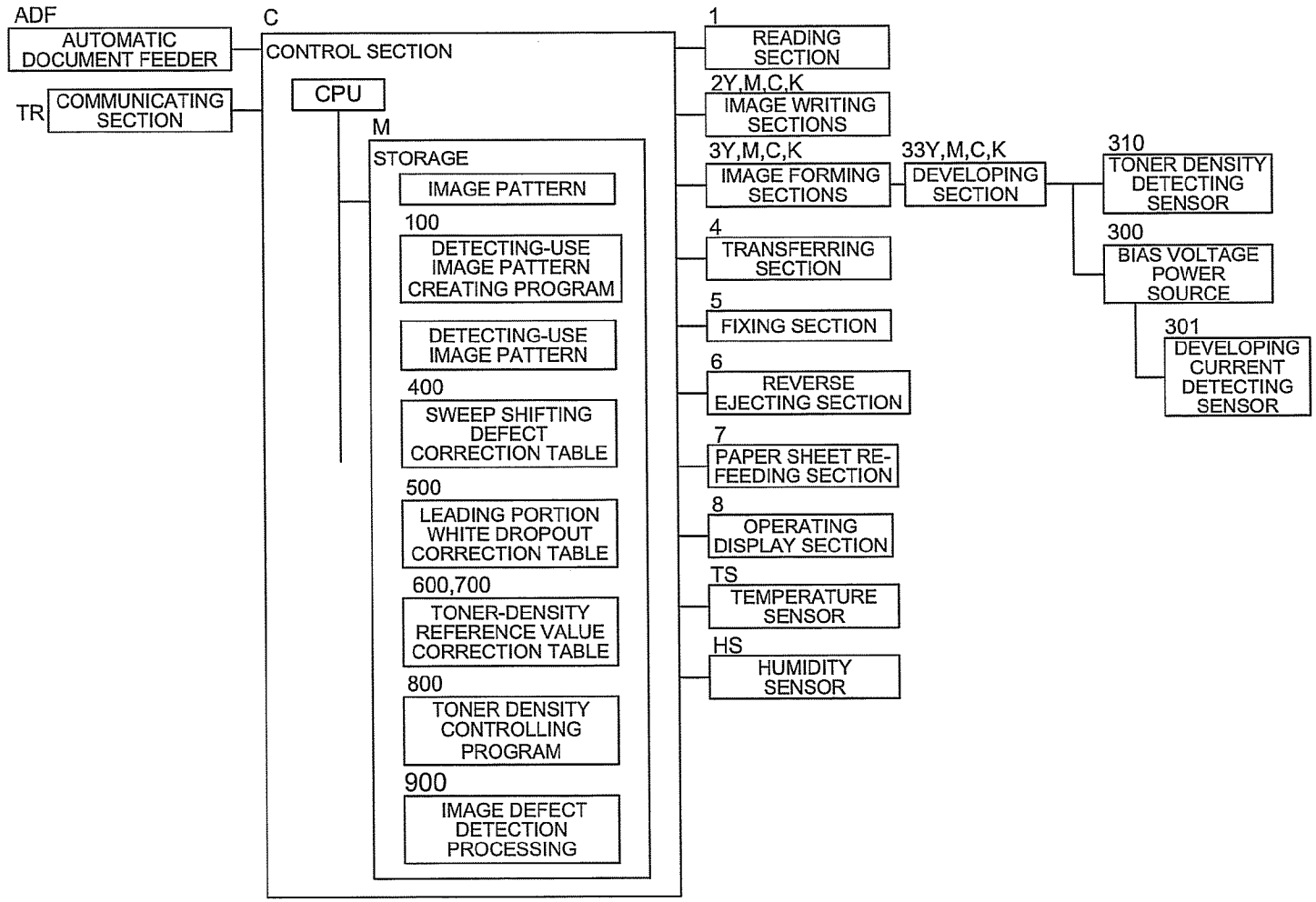
FIG. 2 shows a block diagram of a controlling system of an image forming apparatus embodied in the present invention.

FIG. 2 shows a block diagram of the controlling system of the image forming apparatus G embodied in the present invention.

The control section C of the image forming apparatus G is a computer system, which is constituted by a CPU (Central Processing Unit), the storage M, an Input/Output port, a communication interface, various kinds of circuits for controlling the sections included in the apparatus concerned.

The control section C implements the various kinds of controlling operations by developing a plurality of programs stored in the storage M and by executing the developed programs.

Further, the image forming apparatus G is connectable with another image forming apparatus or an external information processing apparatus, and the control section C conducts information exchanging operations with a control section of the other image forming apparatus, or a control section of the external information processing apparatus, through a communicating section TR.

In this connection, any other blocks, which are not directly pertaining to the descriptions of the present invention, are omitted from the FIG. 2.

Figure 3:
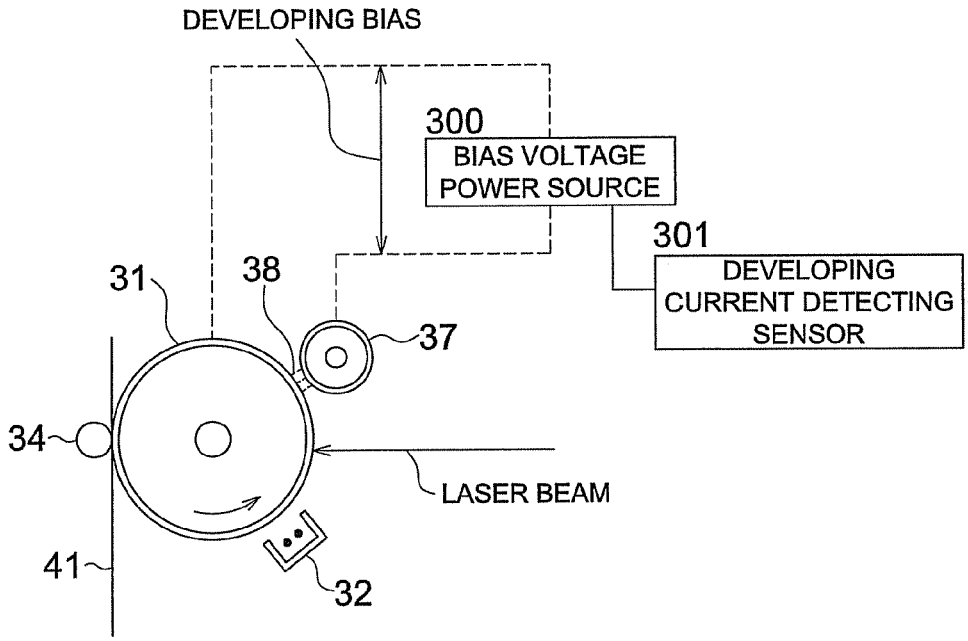
FIG. 3(*a*) shows a conceptual schematic diagram for explaining a developing bias voltage, and FIG. 3(*b*) shows a graph indicating a waveform of the developing bias voltage.
Figure 3:
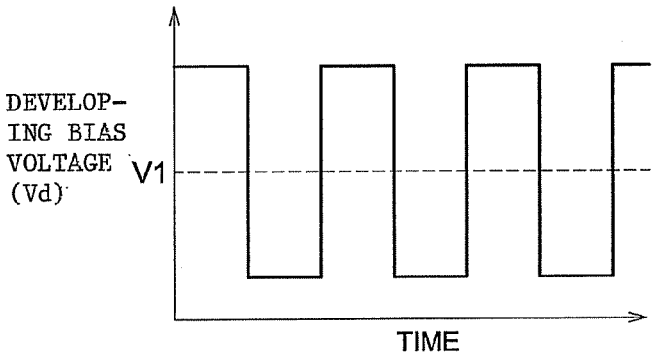

FIG. 3(*a*) shows a conceptual schematic diagram for explaining the developing bias voltage, while FIG. 3(*b*) shows a graph indicating a waveform of the developing bias voltage.

As shown in FIG. 3(*a*), the developing bias voltage is defined as a voltage to be applied to a gap between a developing sleeve 37 of a developing device 33 and a base body of a photoreceptor element 31, as generally well-known.

The polarity and the amplitude of the voltage to be applied are determined depending on kinds of the photoreceptor element and the developing agent to be employed, the process velocity, etc.

In the image forming apparatus G embodied in the present invention, the process velocity is set at 220 mm/s, the photoreceptor element 31 is provided with an organic semiconductor layer formed by dispersing a phthalocyanine pigment into a polycarbonate, and the two-component developing method, using high resistance carriers and toner having a particle diameter of 6.5 μm, is employed for the developing operation.

In the present embodiment, the developing bias voltage (Vd) is applied in such a manner that an electric potential of the photoreceptor element 31 is higher than that of the developing sleeve 37.

Further, as shown in FIG. 3(*b*), the voltage to be applied as the developing bias is formed by superimposing a DC (Direct Current) component and a AC (Alternate Current) component onto each other, and, for instance, a AC voltage having an amplitude of 1 $kV_{peak\text{-}to\text{-}peak}$ and an alternate frequency of 2 kHz is superimposed onto a DC voltage (V1) of 500 V to generate the developing bias voltage.

By applying the abovementioned developing bias voltage generated by a bias voltage power source 300 to the gap between the developing sleeve 37 and the photoreceptor element 31, an alternate electric field 38 is formed between them.

When the photoreceptor element 31 is uniformly charged and no latent image is formed on the photoreceptor element 31, since none of toner retained by the developing sleeve 37 moves onto the surface of the photoreceptor element 31, little electric current flows through the gap between the developing sleeve 37 and the photoreceptor element 31, which is virtually in an insulated state.

On the contrary, during the developing operation, since movements of electric charges occur due to the transporting actions of charged toner, an electric current including a DC component flows through the gap between the developing sleeve 37 and the photoreceptor element 31. Hereinafter, this electric current flowing during the developing operation is denoted as a developing electric current.

In the embodiment of the present invention, a plurality of image patterns, which are different from each other in density, are stored in advance, and then, detecting-use image patterns for detecting the developing characteristics are generated from those image patterns. Successively, the latent images of the detecting-use image patterns are outputted onto the photoreceptor element, so as to store a transient waveform of the developing electric current flowing associated with the latent image outputting operation mentioned in the above, namely a profile of the developing electric current.

In this connection, the developing electric current is represented by the output electric current of the bias voltage power source 300 at the time of the developing operation. A developing current detecting sensor 301 measures the developing electric current, for instance, by measuring a voltage induced between both ports of a resistor inserted into a current flow path through which the developing electric current flows, or by measuring a certain electric current or a voltage residing in the circuit concerned, which varies in proportion to the developing electric current.

Figure 4:
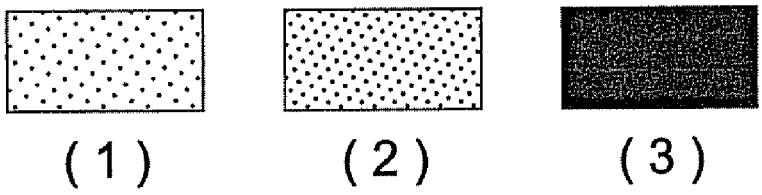
FIG. 4(*a*) shows examples of image patterns, and FIG. 4(*b*) shows examples of detecting-use image patterns.
Figure 4:
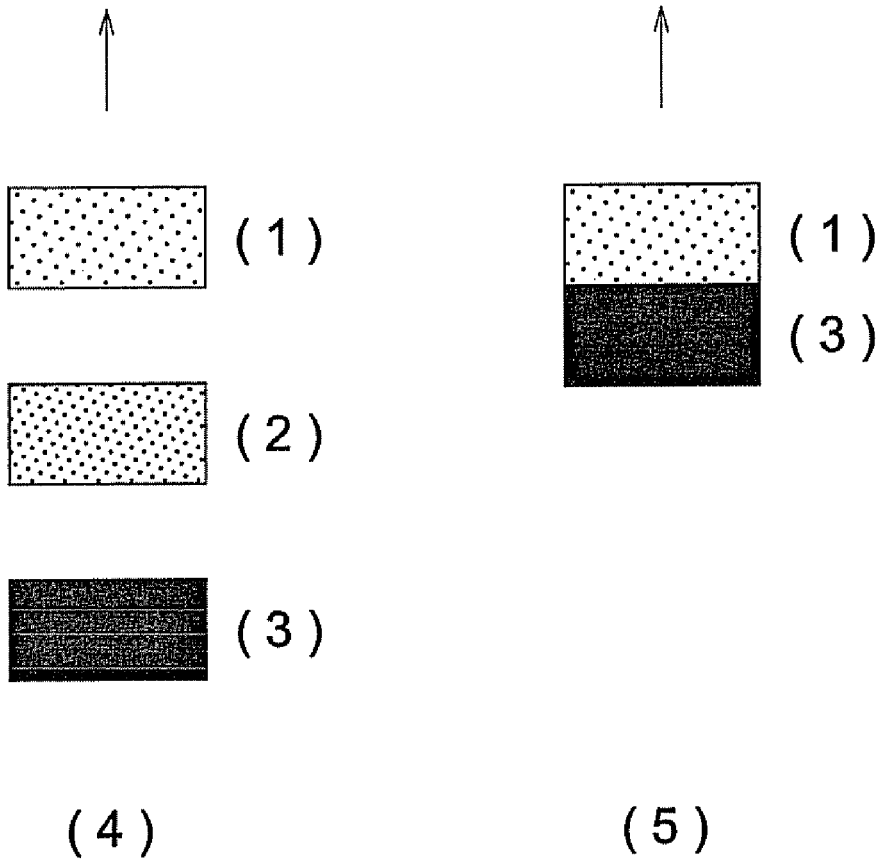

FIG. 4(*a*) shows the image patterns, while FIG. 4(*b*) shows the detecting-use image patterns.

FIG. 4(*a*) shows three rectangular shaped image patterns, which are stored in advance in a predetermined area of the storage M, and are different from each other in density. In this connection, the abovementioned set of image patterns is provided for every primary color, and the number of image patterns for one set is not limited to three.

An image pattern (3) shown in FIG. 4(*a*) represents a maximum density of an image to be outputted, while image patterns (1), (2) shown in FIG. 4(*a*) represent intermediate densities of images to be outputted. However, the densities of the image patterns (1), (2) are different form each other.

Although the shape and size of each image pattern shown in FIG. 4(*a*) are the rectangular shape of 10×20 mm, the appropriate size varies depending on the specification of the image forming apparatus concerned, such as the process velocity, etc., and is to be determined at the time of the apparatus design.

FIG. 4(*b*) shows examples of the detecting-use image patterns (4), (5) generated by aligning the image patterns (1), (2), (3) shown in FIG. 4(*a*). Further, the arrow indicated in FIG. 4(*b*) represents the progressing direction of the photoreceptor element 31.

In the detecting-use image pattern (4), the image patterns (1), (2), (3) are aligned with predetermined intervals in order of low-to-high densities.

On the other hand, in the detecting-use image pattern (5), the image patterns (1), (3) are aligned closely without inserting an interval.

In this connection, the detecting-use image pattern, which is created by executing a detecting-use image pattern creating program 100 stored in the storage M, is employed for measuring the developing electric current so as to acquire a developing electric current profile defined as the transient change of the developing electric current.

As mentioned in the above, the detecting-use image pattern is created by selecting necessary image patterns from the plurality of image patterns, which are stored in advance and different from each other in density, and setting the aligning order of the selected image patterns and its aligning interval.

Figure 5:
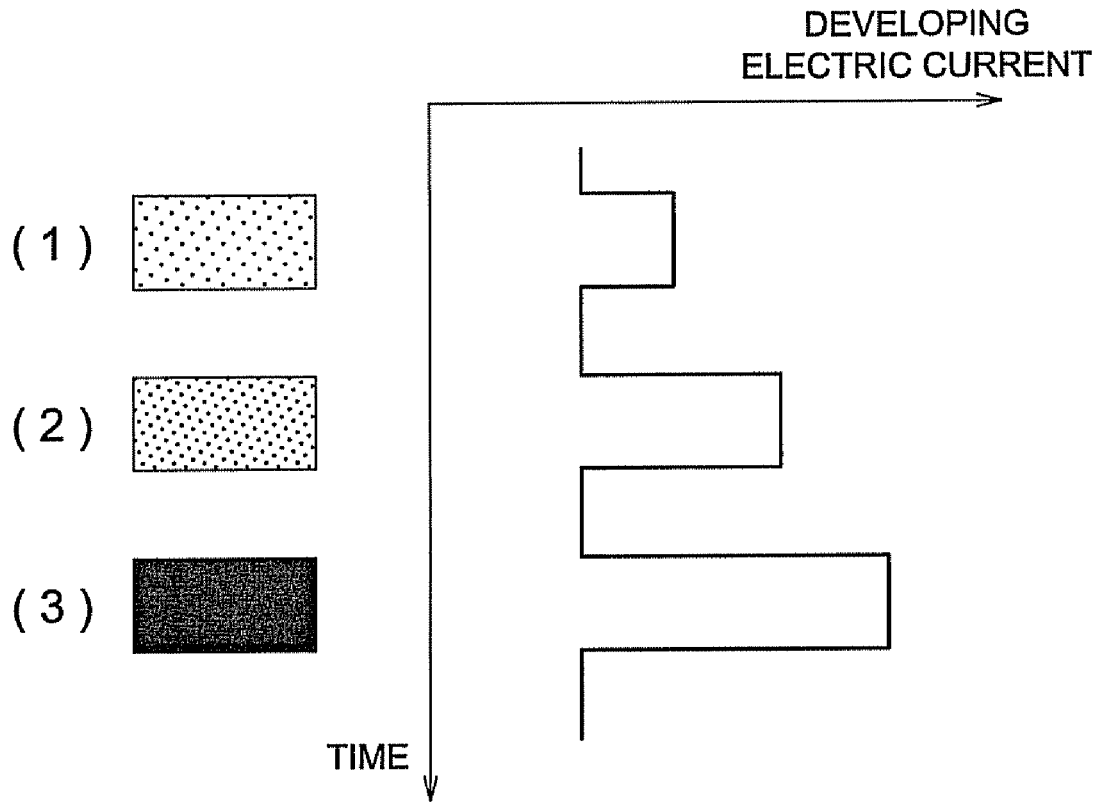
FIG. 5 shows a graph indicating an example of a developing electric current profile.

FIG. 5 shows a graph indicating an example of the developing electric current profile.

Since an amount of toner, corresponding to the density of the detecting-use image pattern formed on each of photoreceptor drums 31Y, 31M, 31C, 31K as its latent image, moves from the developing sleeve 37 to the surface of the photoreceptor drum concerned through the gap, the developing electric current profile as shown in FIG. 5 can be obtained.

Figure 6:
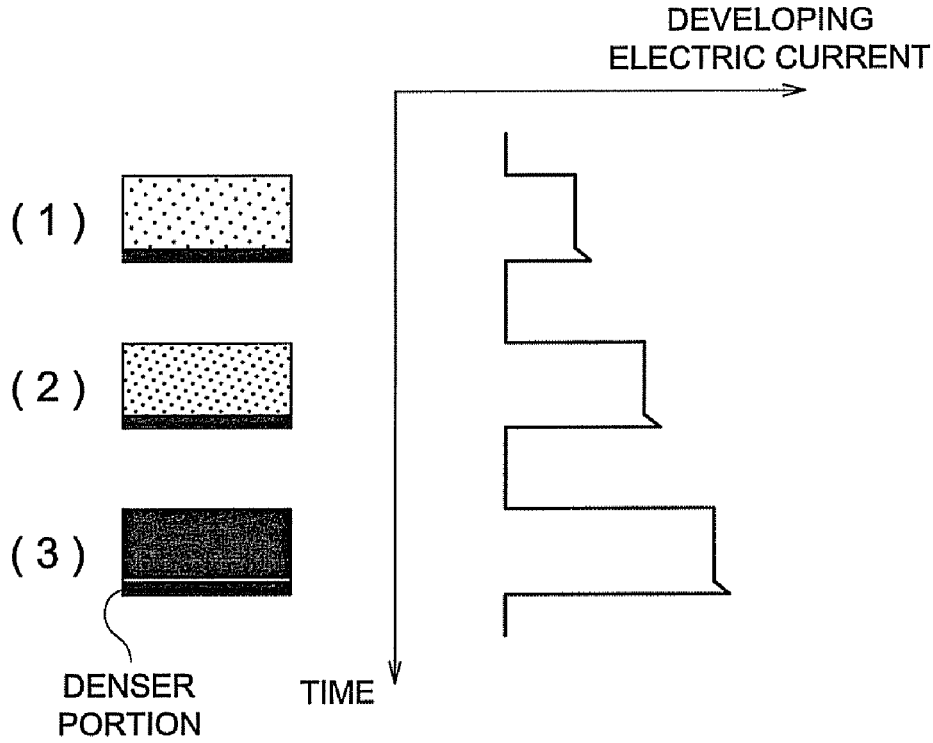
FIG. 6(*a*) and FIG. 6(*b*) show graphs indicating examples of developing electric current profiles acquired from defective images.
Figure 6:
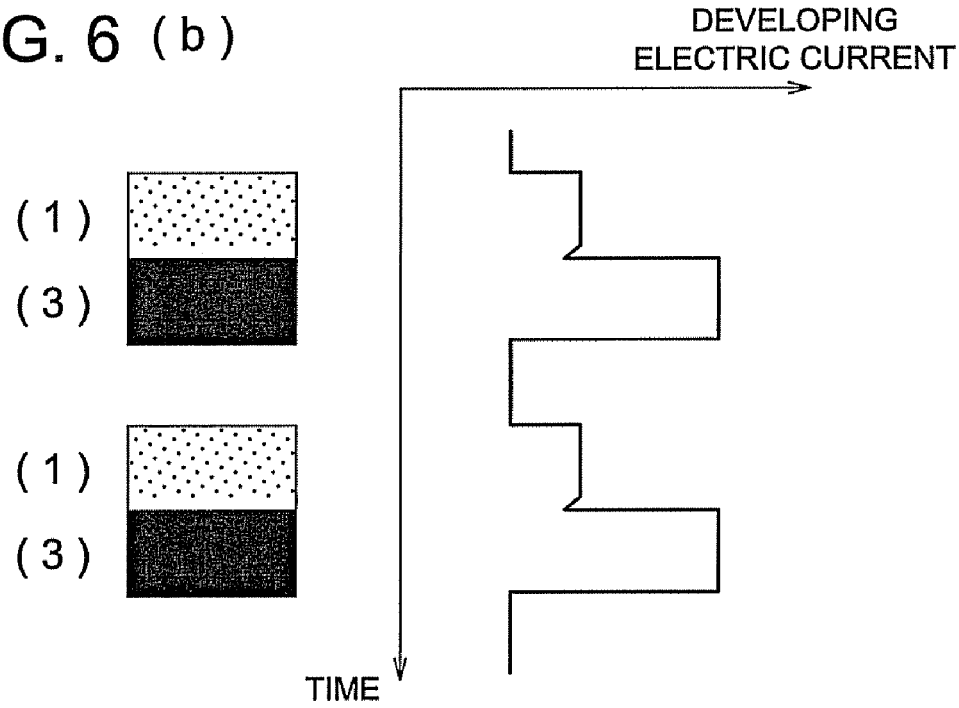

FIG. 6(*a*) and FIG. 6(*b*) show graphs indicating examples of the developing electric current profiles acquired from defective images.

The developing electric current profile shown in FIG. 6(*a*) is obtained, when images having defects called the "sweep shifting", in which a relatively large amount of toner are adhered onto an end edge portion of the toner image, are formed.

Further, when the detecting-use image pattern (5), shown in FIG. 4(*b*), is outputted, sometimes, the developing electric current profile shown in FIG. 6(*b*) is remarkably obtained as a profile indicating a defective image, which is such a defect as called a "leading portion white dropout", in which an amount of toner, to be adhered onto the trailing edge portion of the preceding low-density image, decreases.

It is one of objects of the present invention to prevent an expansion of the defect and to suppress the occurrence of the defective image, by changing the image forming conditions based on the information acquired as a result of quantification of kind and degree of the concerned image defect from the developing electric current profile obtained from such the defective image.

Figure 7:
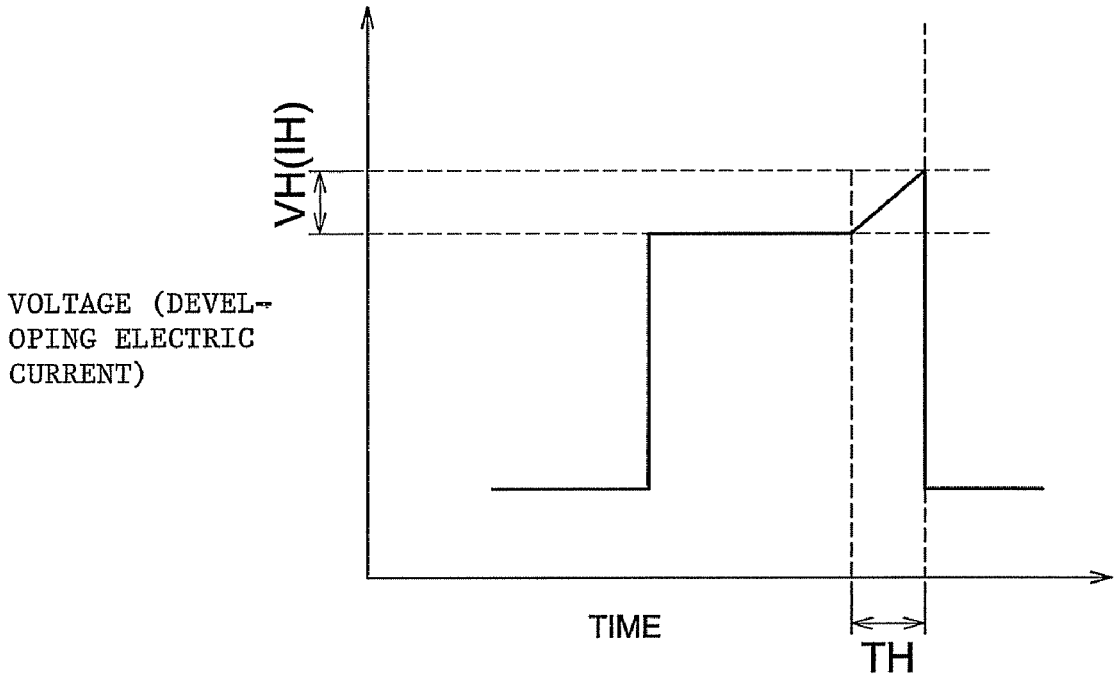
FIG. 7 shows a graph for explaining a quantification of a "sweep shifting"

FIG. 7 shows a graph for explaining the quantification of the "sweep shifting", being one of the possible defects.

Hereinafter in the present invention, a time duration of the increasing transient of the developing electric current from the beginning to the end, due to the increase of the toner adhered amount, is defined as a time TH, and a numerical value, acquired by multiplying an increased amount IH of the developing electric current by the time TH, is defined as a sweep shifting value, serving as a value indicating a degree of the "sweep shifting" defect.

In this connection, as mentioned in the foregoing, the developing electric current profile can be obtained from the profile of the voltage change induced between both ports of the resistor inserted into a current flow path through which the developing electric current flows, or from that of the certain electric current or the certain voltage change residing in the circuit concerned, which varies in proportion to the developing electric current. In the present embodiment, the quantification of the image defect is achieved on the basis of the voltage change VH outputted from the developing current detecting sensor 301.

Concretely speaking, a sweep shifting value F1, indicating a degree of the "sweep shifting" defect as shown in FIG. 7, can be expressed by the Equation indicated as follow.

$$F1 = TH \times VH$$

For instance, when time TH=10 ms, voltage change VH=500 mV, sweep shifting value F1=5000 can be obtain as a product value of them, and is defined as the value indicating a degree of the defect.

As well as the above, the quantification of the leading portion white dropout defect F2 is also defined.

As aforementioned, at first, the control section C outputs the detecting-use image pattern for detecting an objective defect, and then, obtains the developing electric current profile representing the electric current, which flows during the time when the outputted pattern is developed, and finally, conducts its quantification processing.

Successively, based on the quantified defect, such as the sweep shifting value, the leading portion white dropout value, or the like, and referring to a table stored in the storage M and in regard to a correction of the concerned defect, for instance, a sweep shifting defect correction table 400 or a leading portion white dropout correction table 500, the control section C changes the image forming conditions of the image forming sections 3Y, 3M, 3C, 3K.

FIG. 8 shows an example of the sweep shifting defect correction table 400, while FIG. 9 shows an example of the leading portion white dropout correction table 500.

Although the correcting operation conducted by referring to at least one of the correction tables shown in FIG. 8 and FIG. 9 is achieved by changing the condition of the developing bias voltage, it is also effective that this correcting operation is achieved by changing the reference value of the toner density controlling operation based on the quantified value of the sweep shifting defect or the leading portion white dropout defect.

FIG. 10(*a*) and FIG. 10(*b*) show examples of toner-density reference value correction tables 600, 700, which are referred on the occasion of the correcting operation thereof.

FIG. 10(*a*) shows the toner-density reference value correction table 600 to be referred on the basis of the quantified value of the sweep shifting defect, while FIG. 10(*b*) shows the toner-density reference value correction table 700 to be referred on the basis of the quantified value of the leading portion white dropout defect.

As described in the foregoing, after generating the detecting-use image pattern from the plurality of image patterns, which are different from each other in density, by detecting the image defect from the developing electric current profile representing the transition of the electric current during the time when the latent image of the detecting-use image pattern is developed, it is possible to change the image forming conditions so as to prevent the reoccurrence of the detected defect.

It is desirable that such the confirmation of degree of the image defect and the countermeasure thereof should be conducted timely at the time when the concerned image defect would possibly occur.

Figure 11:
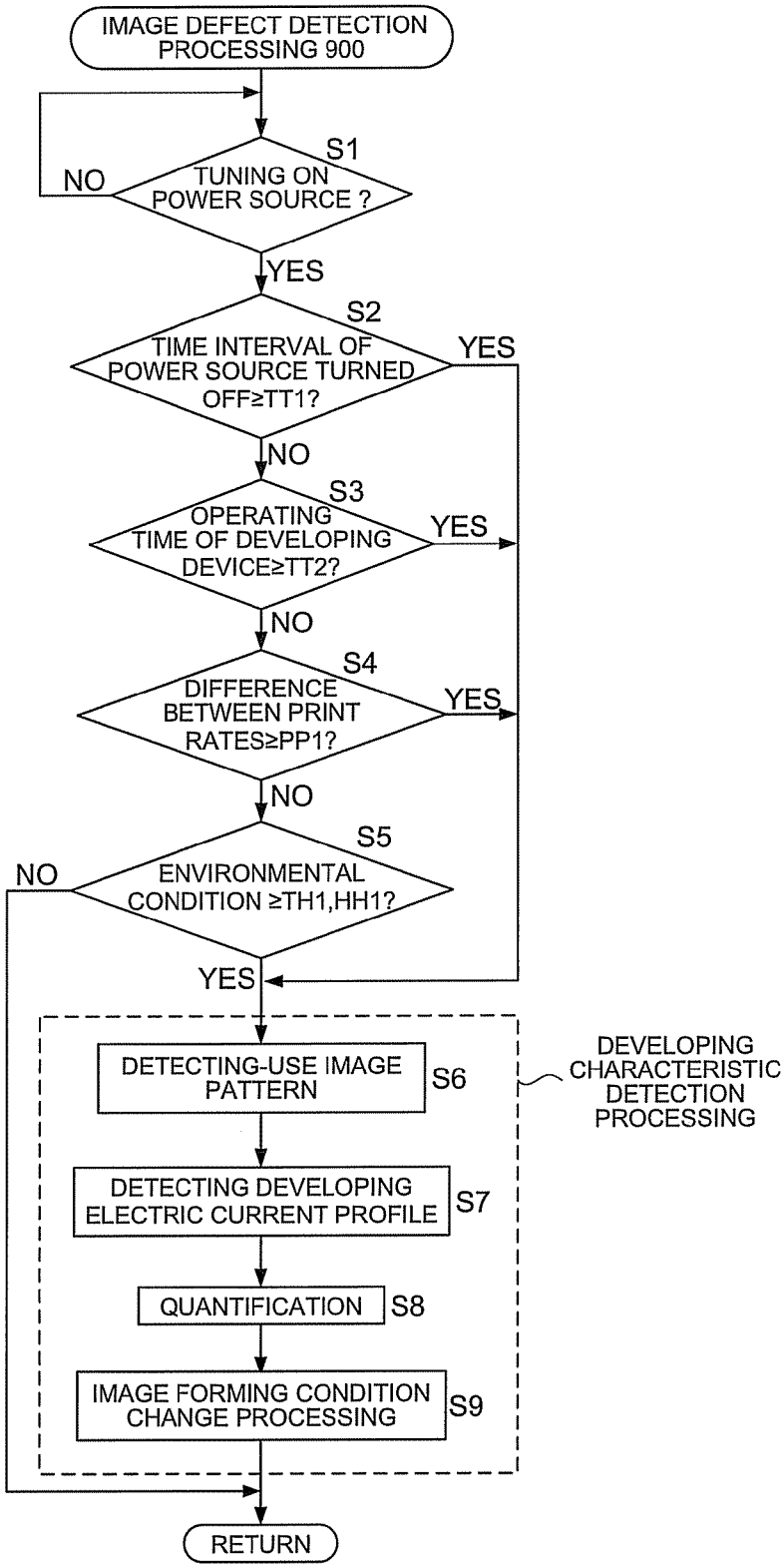
FIG. 11 shows a flowchart indicating a flow of an image defect detection processing.

FIG. 11 shows a flowchart indicating a flow of an image defect detection processing 900.

The flowchart of the image defect detection processing 900, shown in FIG. 11, includes the steps of: tuning ON the power source of the image forming apparatus G, to activate the image forming operation (Step S1: Yes); determining whether or not the time interval during which the power source has been turned OFF is longer than that (time interval TT1) established in advance (Step S2); implementing a developing characteristic detection processing that includes steps 6 through 9, so as to change the image forming condition as needed, when determining that the time interval during which the power source has been turned OFF is longer than time interval TT1 (Step S2: Yes); determining whether or not the cumulative operating time of the developing device 33 becomes longer than time interval TT2 established in advance (Step S3), when determining that the time interval during which the power source has been turned OFF is shorter than time interval TT1 or determining that the power source has been still turned ON (Step S2: No); implementing the developing characteristic detection processing that includes steps 6 through 9, so as to change the image forming condition as needed, when determining that the cumulative operating time of the developing device 33 becomes longer than time interval TT2 (Step S3: Yes); determining whether or not a difference value between a print rate of the current image to be outputted and that of the previous image outputted just before the current image is equal to or greater than value PP1 established in advance, when determining that the cumulative operating time of the developing device 33 is shorter than time interval TT2 (Step S3: No); implementing the developing characteristic detection processing that includes steps 6 through 9, so as to change the image forming condition as needed, when determining that the difference value between the abovementioned print rates is equal to or greater than value PP1 established in advance (Step S4: Yes); and confirming environmental conditions (Step S5), when determining that the difference value between the abovementioned print rates is smaller than value PP1 established in advance (Step S4: No).

In this connection, hereinafter, the environmental conditions represent a temperature and a humidity of the peripheral space of the image forming apparatus G, and/or, another temperature and another humidity of the inner space of the image forming apparatus G, which are measured by temperature sensors TS and humidity sensors HS respectively corresponding thereto.

The flowchart of the image defect detection processing 900, shown in FIG. 11, further includes the steps of: implementing the developing characteristic detection processing that includes steps 6 through 9, so as to change the image forming condition as needed, for instance, when the temperature is equal to or higher than value TH1 established in advance, or the humidity is equal to or higher than value HH1 established in advance, as the result of the measurements of the environmental conditions mentioned in the above (Step S5: Yes); and leaving the subroutine without implementing the developing characteristic detection processing that includes steps G through 9, when the temperature is lower than value TH1 established in advance, or the humidity is lower than value HH1 established in advance (Step S5: No).

In this connection, with respect to the premise condition for determining whether or not the developing characteristic detection processing, including steps 6 through 9, should be implemented, the scope of such the premise condition is not limited to the abovementioned, such as determining whether or not the temperature or the humidity is equal to or higher than the setting value established in advance.

Concretely speaking, for instance, it is also applicable that either an operation for determining whether or not the measured value is within a predetermined range, or another operation for determining whether or not amplitude of the environmental change occurring within a predetermined time interval is equal to or smaller that a predetermined value, is employed as the premise condition mentioned in the above.

Figure 13:
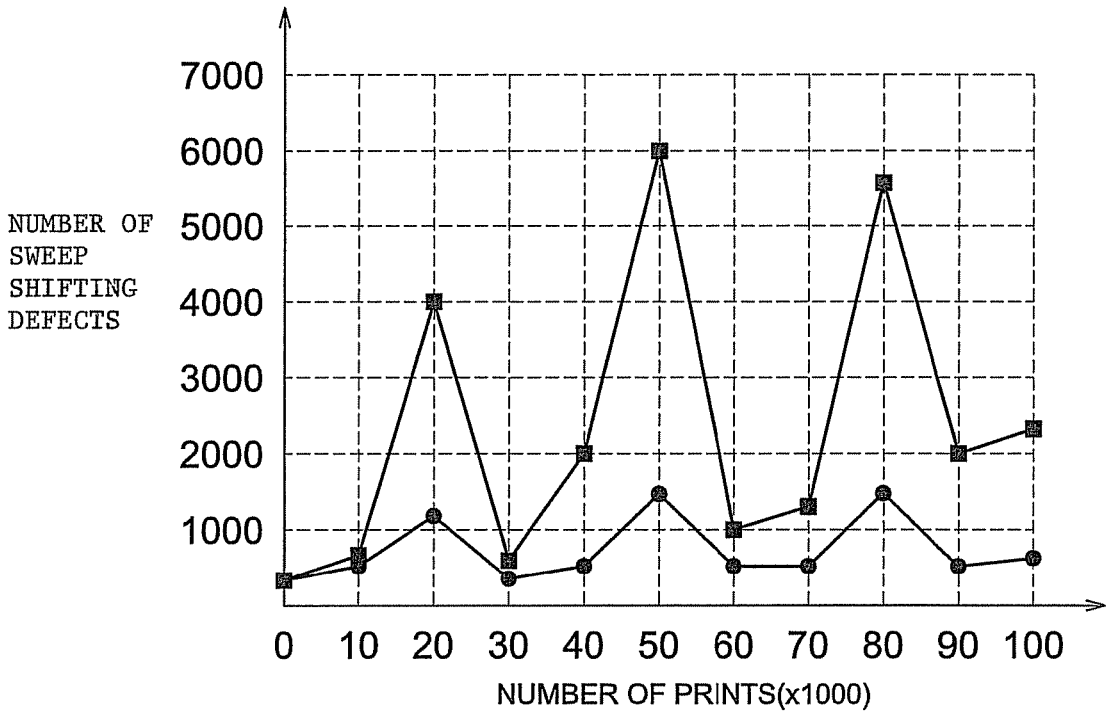
FIG. 13 shows a graph of experimental results when a print rate is 40%.

FIG. 12 shows a table of experimental results indicating changes of the sweep shifting values, while FIG. 13 shows a graph of experimental results when the print rate is 40%.

Further, the conventional controlling operation herein, serving as the comparison object for the present invention, is the well-known controlling method in which the developing bias is changed on the basis of the humidity detecting operation.

From the table and the graph, shown in FIG. 12 and FIG. 13, it is apparent that the increase of the sweep shifting value is prevented as an effect of the present invention, namely, it can be recognized that the image defect, called the "sweep shifting" in which a relatively large amount of toner are adhered onto an end edge portion of the toner image, is effectively suppressed.

As described in the foregoing, according to the present invention, by changing the aligning order or the aligning interval of the plurality of image patterns, which are different from each other in density, the detecting-use image pattern for detecting the degradation of the image quality more sensitively, as the change of the developing electric current, can be created.

Further, the image defect is quantified from the developing electric current profile obtained in the above, so as to change the image forming condition concerned, based on the quantified value.

As a result, compared to such the conventional technique that finds the image defect from the density change of the patch image, which is optically measured, it becomes possible to grasp the change of the developing efficiency of the developing device, provided in the image forming apparatus, more accurately, and accordingly, it becomes possible to prevent the occurrence of the image defect in advance.

According to the present invention, the following effects can be attained.

(1) It becomes possible to grasp the change of the developing efficiency of the developing device provided in the image forming apparatus, more accurately than ever, compared to such the conventional technique that finds the image defect from the density change of the patch image.

(2) Since a plurality of patch images (image patterns), which are different from each other in density, are stored in advance, and then, the detecting-use image patterns for detecting the various developing characteristics can be generated from those patch images, it becomes possible to create a detecting-use image pattern suitable for sensitively detecting an occurrence of a specific defect for every detecting purpose, by changing the aligning order or the aligning interval of the patch images.

As a result, it becomes possible to speedily detect an image defect, in order to take a necessary countermeasure for the image defect concerned at an early stage, resulting in prevention of the quality degradation of the copy image outputted from the image forming apparatus.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus, comprising:

a photoreceptor element to form a latent image on it;

a developing device to develop the latent image formed on the photoreceptor element by transferring toner residing on a developing agent bearing member onto the photoreceptor element under an alternate electric field formed in a gap between the developing agent bearing member and the photoreceptor element;

a developing current detecting sensor to detect a developing current flowing through the gap between the developing agent bearing member and the photoreceptor element; and a control section that conducts consecutive operations of: creating a detecting-use image pattern for detecting a developing characteristic, by aligning a plurality of image patterns, which are different from each other in density; forming a latent image of the detecting-use image pattern onto the photoreceptor element; finding a developing electric current profile, which represents a transition of the developing electric current flowing during an operation of developing the detecting-use image pattern, from an outputted signal of the developing current detected by the developing current detecting sensor; and changing an image forming condition, based on the developing electric current profile found by the finding operation.

2. The image forming apparatus of claim 1, wherein the plurality of image patterns includes both an image pattern having a maximum density value and another image pattern having an intermediate density value.

3. The image forming apparatus of claim 1, wherein the control section selects specific image patterns from the plurality of image patterns, and determines an aligning order or an aligning interval of the specific image patterns to create the detecting-use image pattern.

4. The image forming apparatus of claim 1, wherein the image forming condition to be changed by the control section is at least one of a frequency of a developing bias voltage and a Peak-to-Peak voltage of the developing bias voltage.

5. The image forming apparatus of claim 1, wherein the image forming condition to be changed by the control section is a density of toner to be employed by the developing device.

6. The image forming apparatus of claim 1, wherein the control section changes the image forming condition at such a time when a predetermined time interval has elapsed since an image forming operation of the image forming apparatus was deactivated, and the image forming operation enters into an implementable (operable) state.

7. The image forming apparatus of claim 1, wherein the control section changes the image forming condition at such a time when a cumulative operating time has reached to a predetermined time established in advance.

8. The image forming apparatus of claim 1, wherein the control section changes the image forming condition at such a time when a difference value between a print rate of an image to be currently outputted and that of another image previously outputted has reached to a predetermined value established in advance.

9. The image forming apparatus of claim 1, wherein the control section changes the image forming condition at such a time when an environmental change has exceeded a predetermined range established in advance.

* * * * *